United States Patent [19]

Mast

[11] 4,372,332

[45] Feb. 8, 1983

[54] COMPRESSOR STATION FOR ARCTIC GAS PIPELINE

[76] Inventor: Burton T. Mast, 9419 Stockport, Spring, Tex. 77373

[21] Appl. No.: 229,207

[22] Filed: Jan. 28, 1981

[51] Int. Cl.[3] ..... F17D 1/07

[52] U.S. Cl. ..... 137/1; 137/236 R; 62/55; 62/260

[58] Field of Search ..... 62/88, 55, 260; 417/243; 137/13, 1, 236

[56] References Cited

U.S. PATENT DOCUMENTS 3,200,613 8/1965 Zotos ..... 62/88 X 3,494,145 2/1970 Davis ..... 62/88 X

*Primary Examiner*—Alan Cohan

*Attorney, Agent, or Firm*—Michael P. Breston

[57] ABSTRACT

The cold decompressed gas flowing into the compression station is preheated by the compressed warmer gas discharged by the station's compressor, thereby raising the temperature of the compressed gas at the discharge outlet of the compressor. The warm compressed gas discharged by the compressor is cooled with ambient air and with the cold decompressed gas stream flowing into the station. If required, to still further reduce its temperature, the cold compressed gas stream is expanded until its temperature approaches the temperature of the gas within the pipeline.

The apparatus of the invention includes a gas-to-gas heat exchanger wherein the decompressed cold gas is first preheated by the counterflowing warm compressed gas. The preheated gas is allowed into the inlet of the compressor. The temperature of the warm compressed gas from the discharge outlet of the compressor is first reduced by a gas-to-air heat exchanger. The temperature of the gas stream flowing out of the gas-to-air heat exchanger is further reduced by the gas-to-gas heat exchanger. Finally, if required, further temperature reduction is achieved within an expander.

10 Claims, 3 Drawing Figures

FIG. 1.
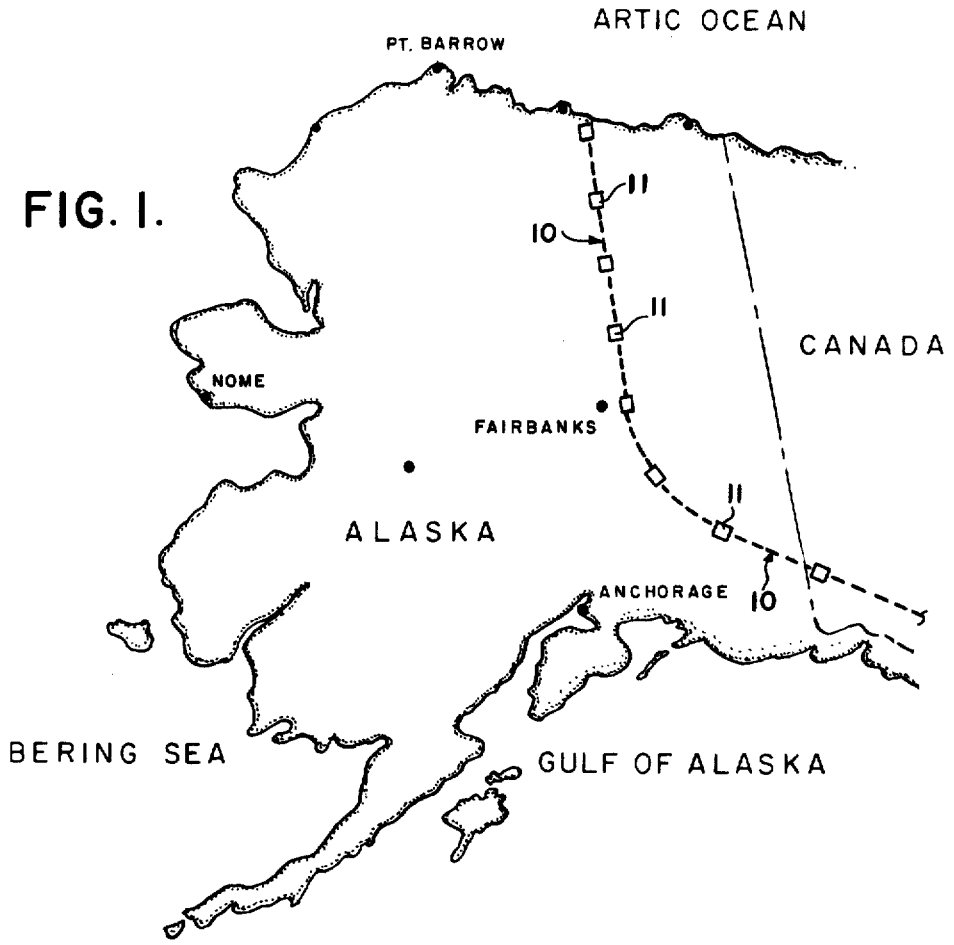
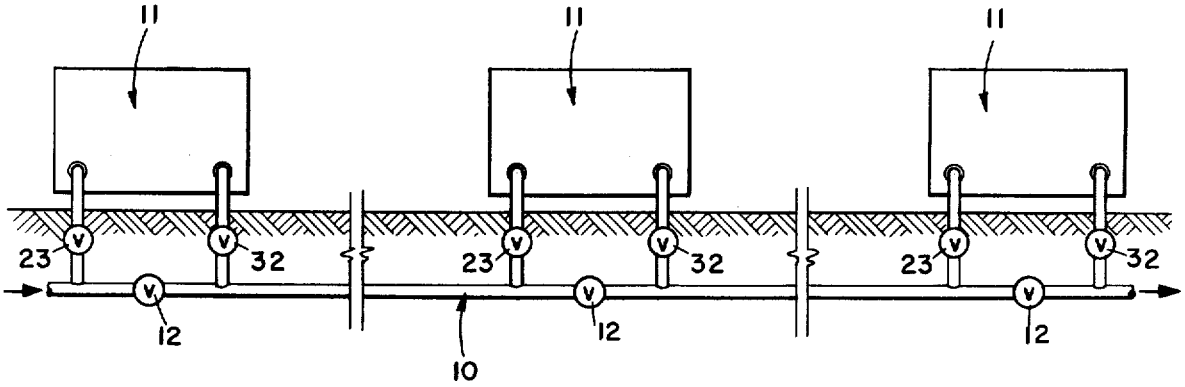
FIG. 2.

COMPRESSOR STATION FOR ARCTIC GAS PIPELINE

BACKGROUND OF THE INVENTION

1. Field of the Invention

This invention relates to an arctic pipeline, having a portion which is under the surface of the permafrost region, for restoring the transmission pressure losses.

2. Description of the Prior Art

The planned Alaskan natural-gas pipeline system may have a length of 9,000 km at a cost of more than 25 billion dollars. A portion of the pipeline will be below the surface of the permafrost. To prevent damage to ecology and to the pipeline itself, the temperature of the gas stream flowing within the pipeline must be continuously maintained at or below 0° C. A higher temperature than 0° C. might warm up the pipeline and melt the surrounding permafrost. The gas stream within the pipeline must also be maintained above a predetermined threshold pressure level to allow continuous gas flow through the pipeline. The gas sustains a transmission pressure loss as it flows south from the northern arctic regions. It is being proposed to restore the pressure loss by recompressing the gas in compressor stations suitably spaced along the length of the line.

Each station is intended to have a compressor powered by a suitable prime mover. The compressor will raise the pressure of the gas to the maximum pressure allowed within the pipeline. Unfortunately, the act of gas compression is accompanied also by an inevitable and undesirable temperature rise. Therefore, the compressed gas discharged by the compressor cannot be re-injected into the pipeline until its temperature is reduced to the temperature of the gas specified for the pipeline, which is typically 0° C. or less.

A considerable amount of research went into developing a process for cooling the warm compressed gas which is discharged by the compressor in the compressor station. It has been proposed by others that this warm compressed gas be cooled by a mechanical refrigeration system utilizing a refrigeration compressor for pumping and compressing a refrigerant fluid. This fluid circulates within a cooling coil. The compressed warm gas is made to pass through the cooling coil, and is cooled to 0° C. or less, which is the temperature of the gas within the pipeline. In the process of cooling the gas stream, the refrigerant fluid warms up. To remove the heat from the refrigerant fluid, it is pumped by the refrigerator compressor to several conventional air coolers.

The use of a mechanical refrigeration system for reducing the temperature of the warm compressed gas discharged by the compressor within the compressor station is technically sound. But, a mechanical refrigeration system is relatively costly to install, maintain, and operate. It consumes a relatively large amount of energy. The refrigeration compressor has to operate not only in the summer time but also in the winter months, at which time the ambient air may be −25° C. or less. Relatively expensive refrigeration spare parts must be maintained for repairing the refrigeration equipment, and such repairs require skilled mechanics. To avoid shutting down the compressor station, it must have a complete standby refrigeration unit, thereby considerably increasing the cost of operating the pipeline.

It is the primary object of the present invention to provide a process and equipment for reducing the temperature of the compressed warm gas discharged by the gas compressor within the compressor station without utilizing a refrigeration system as above described.

The employed temperature reducing process of this invention is relatively economical because it requires less costly machinery, consumes less energy, reduces the frequency of machinery failure, utilizes machinery with less moving parts, and takes full advantage of the ambient air temperature for cooling the warm gas stream discharged from the gas compressor. Thus, in the colder months of the year, the energy consumed for cooling the warm compressed gas stream is at a minimum.

SUMMARY OF THE INVENTION

In accordance with the process of the invention, the cold decompressed gas flowing into the compression station is preheated by the compressed warm gas discharged by the station's compressor, thereby raising the temperature of the compressed gas at the discharge outlet of the compressor to a desired temperature level above the ambient air temperature. The warm compressed gas discharged by the compressor is cooled with ambient air and with the cold decompressed gas stream flowing into the station. If required, to still further reduce its temperature, the cold compressed gas stream is expanded until its temperature approaches the temperature of the gas within the pipeline.

Thus, in accordance with the invention, the preheated decompressed gas stream is compressed by the compressor, a portion of the heat of compression is transferred from the warm compressed gas to the ambient air, a portion of the heat is transferred from the compressed gas to the cold decompressed gas stream entering the station, and, if required, a portion of the heat of compression is removed from the compressed gas by expanding it until its temperature is further reduced to the temperature of the gas within the pipeline.

The process of the invention can be carried out by passing the incoming cold decompressed gas stream through a gas-to-gas heat exchanger wherein the decompressed cold gas is first preheated by the counterflowing warm compressed gas. The preheated gas is allowed into the inlet of the compressor. The temperature of the warm compressed gas from the discharge outlet of the compressor is first reduced by a gas-to-air heat exchanger. Since the warm compressed gas at the discharge outlet of the compressor has a temperature which is considerably higher than the ambient air temperature, even during the summer months, a portion of the heat of compression induced into the gas stream by the compressor can be inexpensively transferred to the ambient air by the gas-to-air heat exchanger.

The temperature of the gas stream flowing out of the gas-to-air heat exchanger will be above the ambient air temperature, depending on the efficiency and quantity of heat transfer surface of the gas-to-air heat exchanger. The temperature of the gas stream flowing out of the gas-to-air heat exchanger is further reduced by the gas-to-gas heat exchanger which removes heat from the compressed gas stream and transfers it to the incoming cold gas stream flowing into the station. Finally, if required, further temperature reduction is achieved within an expander.

In accordance with the invention, the mechanical refrigeration system previously believed necessary has been eliminated. Instead, the gas compressor within the station has been made of larger horsepower, as required to compress the preheated decompressed gas stream. However, the larger horsepower gas compressor required by the invention still uses less energy than the previously proposed process requiring in addition to a gas compressor, a refrigeration compressor as well, and several cooling towers.

BRIEF DESCRIPTION OF THE DRAWINGS

FIG. 1 is a plan view of the Alaskan gas pipeline together with its compressor stations;

FIG. 2 is a partial sectional view of the earth formation containing the pipeline.

DESCRIPTION OF PREFERRED EMBODIMENTS

Figure 3:
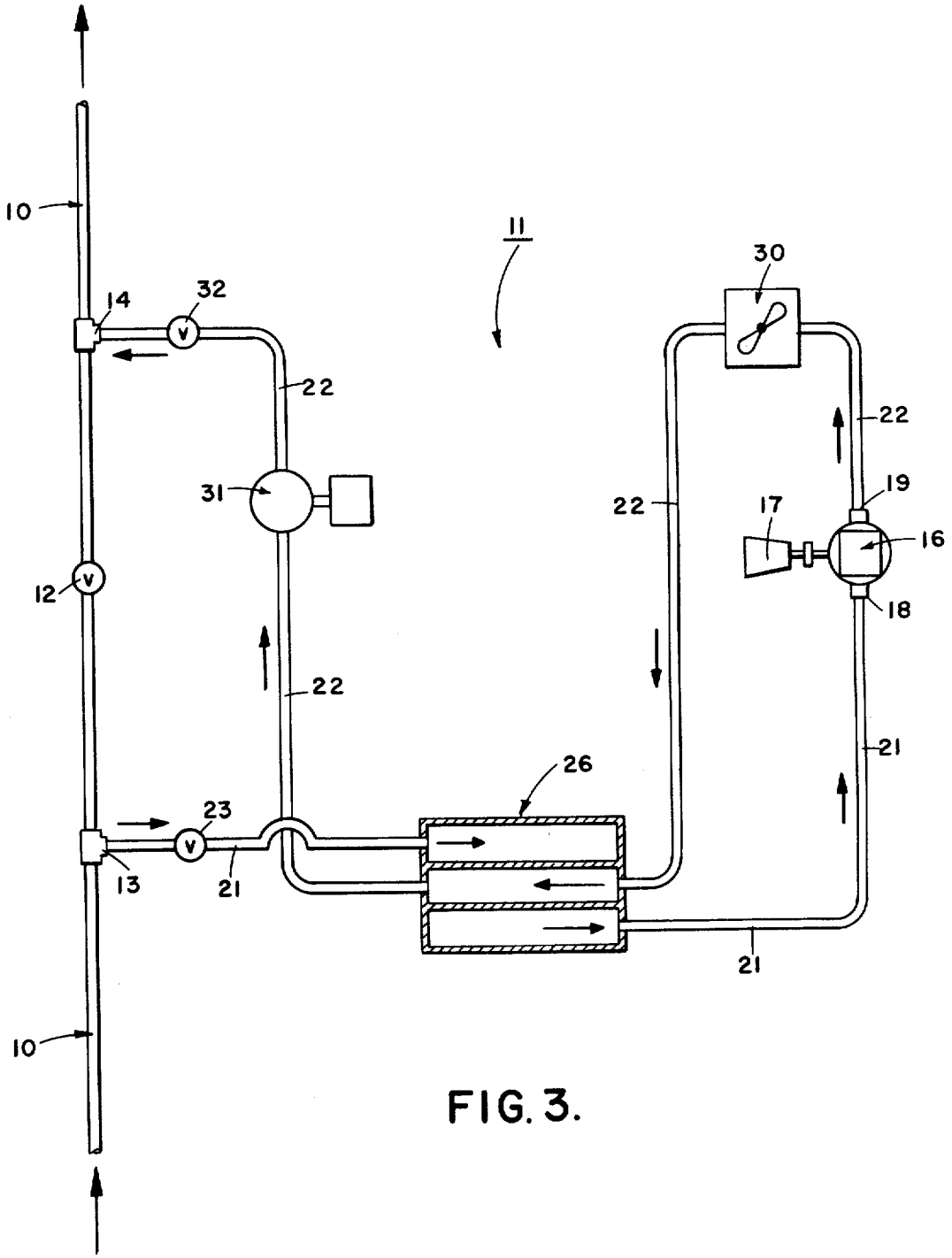
FIG. 3 is a schematic diagram of the process and equipment utilized within a compressor station in accordance with the invention.

FIGS. 1 and 2 represent a pipeline 10 originating for example in Alaska at the North Slope, passing near Fairbanks, and turning south-eastwardly toward Canada. Pipeline 10 includes a number, say seven, compressor stations 11 which are spaced along the line.

With reference to FIG. 3, the purpose of each compressor station 11 is to recompress the gas between its inlet port 13 and outlet port 14 so as to make up for the loss of pressure in the gas as it moves downstream, in the direction of the arrows.

A block valve 12 between inlet port 13 and outlet port 14 is closed when the station is in operation. A large gas compressor 16, powered by a suitable driver such as a gas turbine 17, has a suction inlet 18 and a discharge outlet 19. The gas path between the station's inlet port 13 and the compressor's inlet 18 will hereinafter be referred to as the "suction path" 21. The gas path between the compressor's outlet 19 and the station's discharge port 14 will be referred to as the "discharge path" 22.

The suction path 21 includes a valve 23 for admitting the flow of cold decompressed gas into the station, and a gas-to-gas, conventional heat exchanger 26 in which the cold decompressed gas stream entering suction path 21 is preheated by the counterflowing, warmer compressed gas stream flowing in discharge path 22.

Compressor 16 increases the pressure of the decompressed gas to a pressure level such that the pressure at the station's outlet port 14 will be at or close to the maximum allowed pressure level in line 10. The act of compressing the gas is inevitably accompanied by the gas receiving heat of compression or an undesirable rise in temperature. Therefore, the compressed gas, exiting from compressor 16 at its outlet 19, must be cooled to a temperature of 0° C. or less.

For this purpose, the compressed gas is cooled by a gas-to-air heat exchanger 30, known as a "fin-fan". From fin-fan 30, the cooled, compressed gas flows through the heat exchanger 26, an expander 31, and a station outlet valve 32.

In operation, the cold, decompressed gas stream flowing into the heat exchanger 26 is preheated by the counterflowing warmer compressed gas in the discharge path 22, so that the temperature of the decompressed gas is raised, and the temperature of the compressed gas is lowered.

Compressed 16 increases the pressure of the preheated decompressed gas as well as its temperature. The temperature of the compressed gas at outlet 19 is at a level which is sufficiently high that a portion of the heat of compression, induced by compressor 16, can be transferred directly to the ambient air, even during the warmest days of the year, without the aid of a refrigerant-type cooling coil.

The compressed warm gas discharged by compressor 16 is cooled by the fin-fan 30 which transfers a portion of the heat of compression from the compressed gas stream to the colder ambient air. The temperature of the compressed gas stream flowing out of fin-fan 30 will be always above the ambient air temperature by a number of degrees depending on the efficiency and the amount of the heat transfer surface in fin-fan 30.

As it continues to flow along the discharge path 22, the gas passes through the gas-to-gas heat exchanger 26, wherein the counterflowing compressed gas stream transfers a portion of its heat to the cold decompressed gas stream entering station 11.

The compressed gas stream flowing out of heat exchanger 26 will have a temperature which is higher than the temperature of the decompressed gas stream entering exchanger 26. Since the temperature of the decompressed gas stream entering exchanger 26 can be as high as 0° C., the temperature of the compressed gas stream flowing out of exchanger 26 can be higher than 0° C.

In that case, expander 31 will remove a portion of the heat of compression from the counterflowing compressed gas stream so as to reduce its temperature to 0° C. or less. In the expander 31, the gas stream expands and does work, and in so doing its temperature and pressure are decreased. The amount of gas temperature decrease which is required from expander 31 is relatively small and, therefore, the accompanying gas pressure drop will also be relatively small.

The major gas temperature drops for the compressed gas stream in path 22 will occur in fin-fan 30 and in the heat exchanger 26. The temperature and the pressure of the compressed gas stream at the output of expander 31 will then be such that the gas stream can be injected through valve 32 into port 14 of pipeline 10.

Thus, it will be appreciated that instead of a mechanical refrigerating unit being utilized in the discharge path 22, as has heretofore been proposed, there is employed in accordance with the invention an open-loop, heat-rejection path including a gas-to-air heat exchanger 30, which requires relatively little horsepower, and a gas-to-gas heat exchanger 26. The horsepower now required to drive gas compressor 16 will be relatively higher than that required by a gas compressor in a compressor station utilizing a mechanical refrigeration unit. This is so because compressor 16, in accordance with the invention, has to compress preheated gas instead of cold gas. However, the overall horsepower required by compressor station 11, in accordance with the invention, is still considerably smaller than that required by a station utilizing a mechanical refrigeration unit.

A plurality of compressor turbine units can be connected in parallel, and, therefore, the failure of one turbine will not impair the operation of the complete compressor station 11.

The overall cost of fin-fan 30, exchanger 26 and expander 31 is appreciably less than the cost of the proposed mechanical, closed-loop refrigeration unit. Also, the energy consumed by the compression station 11 of the invention is less than that which would be consumed by a station utilizing mechanical refrigeration.

Exchanger 26 can be a shell-and-tube type heat exchanger, fin-fan 30 can be a finned tube unit with a fan, and expander 31 can be a reciprocating or centrifugal type expander, all readily available from different commercial sources.

It will also be appreciated that on colder days, when the ambient air temperature falls, the fin-fan unit 30 will cool the gas stream discharged from compressor 16 to such an extent that the gas stream discharged by exchanger 26 will have a temperature less than 0° C. Consequently, a further temperature reduction is not required, and expander 31 need not be operated.

Also, when the temperature of the decompressed gas entering suction port 13 is sufficiently below 0° C., this cold gas stream will cool the counterflowing compressed gas stream in exchanger 26 to such an extent that at the output of exchanger 26 the temperature of the compressed gas will be less than 0° C. In that case, expander 31 will also not be operated.

Finally, during the coldest months of the year, fin-fan 30 may cool the compressed warm gas discharged by compressor 16 to a temperature at or below 0° C. As a consequence, there would be no need to further reduce the temperature of the gas stream flowing out of fin-fan 30, since it can then be injected directly into port 14 of pipeline 10. In this case, neither heat exchanger 26 nor expander 31 need to be operated.

As a direct consequence, the process of the invention allows maximum use of the ambient air for transferring the heat of compression thereto.

What is claimed is:

1. In a method for transporting gas through a pipeline system comprising a long pipeline for transporting cold gas from arctic regions through freezing ground, and a plurality of recompression stations spaced along the length of the pipeline, each station receiving upstream from the pipeline decompressed gas and returning downstream to the pipeline recompressed cold gas to thereby overcome the transmission pressure losses through the pipeline, the improvement including:

(a) recompressing the received decompressed gas from the pipeline;

(b) cooling the recompressed gas resulting from step (a) with ambient air;

(c) further cooling the recompressed gas resulting from step (b) with the received decompressed cold gas from the pipeline before recompressing the decompressed gas as provided in step (a); and (d) injecting the recompressed gas resulting from step (c) into the pipeline.

2. The method of claim 1, wherein the heat of recompression in the recompressed gas resulting from step (b) is substantially completely removed by the ambient air utilized in step (b).

3. The method of claim 2, and (d) further cooling the recompressed gas resulting from step (c) before injecting it into the pipeline.

4. The method of claim 3, wherein said cooling in step (d) is obtained by expanding the recompressed gas.

5. In a system for transporting gas including a long pipeline for transporting cold gas from arctic regions through freezing ground, and a plurality of recompression stations spaced along the length of the pipeline, each station receiving upstream from the pipeline decompressed gas and returning downstream to the pipeline recompressed cold gas to thereby overcome the transmission pressure losses through the pipeline, the improvement including:

(a) a compressor for recompressing the received decompressed gas from the pipeline;

(b) first means for cooling the recompressed gas from the compressor with ambient air;

(c) second means for cooling the recompressed gas from the first means with the received decompressed cold gas from the pipeline before the decompressed gas is recompressed by the compressor; and (d) means injecting the recompressed gas from said second means into the pipeline.

6. The system of claim 5, wherein the heat in the recompressed gas resulting from the recompression is substantially completely removed by said ambient air.

7. The system of claim 6, and third means for cooling the recompressed gas before injecting it into the pipeline.

8. The system of claim 7, wherein said third means is an expander.

9. The system of claim 5, wherein said first means is a gas-to-air heat exchanger.

10. The system of claim 5, wherein said second means is a gas-to-gas heat exchanger.

* * * * *